US005249978A

United States Patent [19]

Gazda et al.

[11] Patent Number: 5,249,978

[45] Date of Patent: Oct. 5, 1993

[54] HIGH POWER CONNECTOR

[75] Inventors: Dennis J. Gazda, Binghamton; Richard L. Stark, Auburn; Louis R. Strnatka, Binghamton, all of N.Y.

[73] Assignee: International Business Machines Corporation, Armonk, N.Y.

[21] Appl. No.: 914,811

[22] Filed: Jul. 15, 1992

[51] Int. Cl.[5] ..... H01R 13/629

[52] U.S. Cl. ..... 439/246

[58] Field of Search ..... 439/246-252

[56] References Cited

U.S. PATENT DOCUMENTS

| | | | |
|---|---|---|---|
| 268,329 | 11/1882 | Weston | 439/247 |
| 1,011,402 | 12/1911 | Bliss | 439/247 |
| 2,882,510 | 4/1959 | Colvin | 439/248 |
| 4,162,816 | 7/1979 | Malsot | 439/246 |
| 4,307,431 | 12/1981 | Sone et al. | 361/214 |
| 4,361,372 | 11/1982 | Majkrzak et al. | 439/247 |
| 4,451,102 | 5/1984 | Reh | 439/261 |
| 4,647,743 | 3/1987 | Kern et al. | 200/275 |
| 4,697,859 | 10/1987 | Fisher, Jr. | 439/246 |
| 4,909,748 | 3/1990 | Kozono et al. | 439/247 |
| 4,967,311 | 10/1990 | Ferchay et al. | 361/395 |

FOREIGN PATENT DOCUMENTS

| | | | |
|---|---|---|---|
| 1007857 | 5/1957 | Fed. Rep. of Germany | 439/246 |
| 2907039 | 8/1980 | Fed. Rep. of Germany | 439/252 |
| 0251616 | 2/1990 | Japan . | |
| 445092 | 12/1974 | U.S.S.R. . | |
| 2214727 | 9/1989 | United Kingdom | 439/246 |

OTHER PUBLICATIONS

IBM Technical Disclosure Bulletin, vol. 28, No. 7, Dec. 198 pp. 3211-3212 Goldfarb et al., "Connector Socket With 'Floating Attachment To Bus Bar".

RO886-0198, Kleve et al. Research Disclosure, May 1989, No. 30 "Floating Connector".

*Primary Examiner*—Gary F. Paumen

*Attorney, Agent, or Firm*—William H. Steinberg

[57] ABSTRACT

A multiple terminal connector capable of self alignment and blind plugging. The connector has high current and high voltage capabilities and allows flexibility in the positioning of connectors on a chassis since large amounts of misalignments can be tolerated. Spring means bias terminal stabs towards a central position while allowing lateral float to accommodate misalignment.

15 Claims, 3 Drawing Sheets

HIGH POWER CONNECTOR

BACKGROUND OF THE INVENTION

The present invention relates generally to electrical connectors and more particularly to a multiple terminal high energy handling connector capable of self alignment and blind plugging.

In an N+1 power supply system, N power converters are needed to provide full system power, with one additional power supply for back up. If a concurrent maintenance feature is provided, which allows replacement of a failed unit without removing the voltage from a common bus into which the converter connects, a failed unit can be replaced while the remaining power converters are still operating providing power to the load for uninterrupted operation.

When each of the converters operate at high currents, 60 to 200 amperes, for example, and have input voltages of approximately 480 VAC and DC output voltages of approximately 350 volts and 50 amperes, connectors are not available allowing self aligning blind plugging of multiple contact connectors on different planes of the chassis of the power supply while providing mechanical protection of the terminals and electrical isolation of the contacts. When high voltages and currents are present, connectors by design must be larger and have increased spacing between terminals. Bus bars carrying the high voltage to which the converters have to connect have wider spacing to avoid arcing. These conditions combine to increase the difficulty in achieving self alignment of multiple contacts.

It is an object of the present invention to provide a high voltage, high current multiple terminal pluggable connector which is capable of blind plugging and self alignment.

It is another object of the present invention to provide a high voltage, high current multiple terminal pluggable connector which is capable of blind plugging and self alignment of widely spaced connectors.

It is still another object of the present invention to provide a high voltage, high current multiple terminal pluggable connector which is capable of blind plugging and self alignment of widely spaced connectors located on different parallel surfaces.

SUMMARY OF THE INVENTION

In one aspect of the present invention a connector including a housing defining a cavity having a central portion opening to the exterior of the housing is provided. A terminal with a stab portion extending from a base is slidably mounted in the cavity, with the stab portion extending through the opening. The stab portion is biased to a central position in the opening by spring means.

In another aspect of the present invention a multi-terminal connector for coupling to connectors mounted on bus bars is provided. The connector includes a housing defining a plurality of cavities each having a central portion opening to the exterior of the housing. A plurality of terminals are provided each having a base and a stab portion extending from the base. The bases are slidably mounted in a corresponding one of the cavities with the stab portions extending through the openings. The stab portions are each biased to a central position in the openings by spring means.

DETAILED DESCRIPTION OF THE INVENTION

Figure 1:
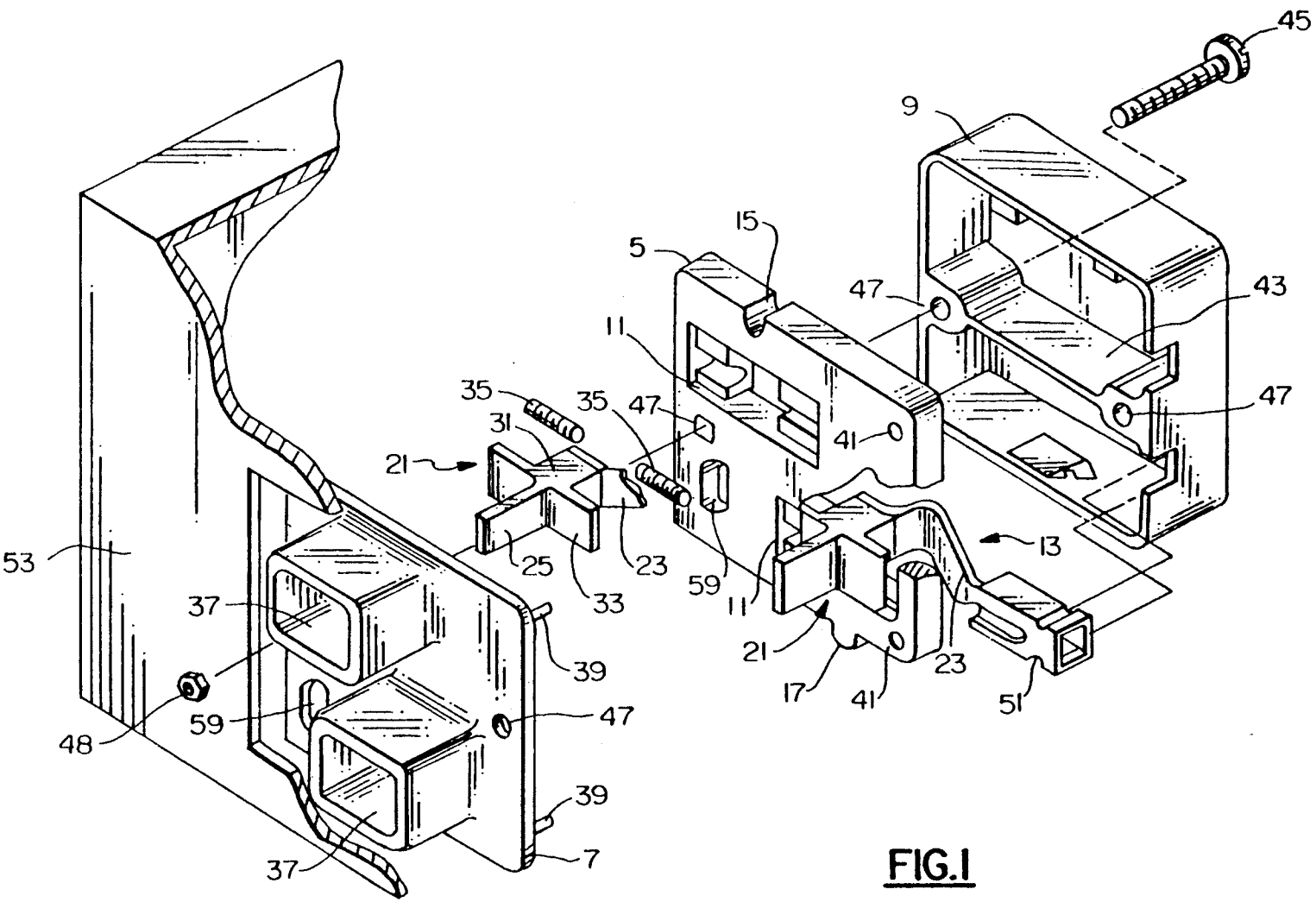
FIG. 1 is an exploded axonometric view, partially cut away, of a connector in accordance with one embodiment of the present invention.
Figure 2:
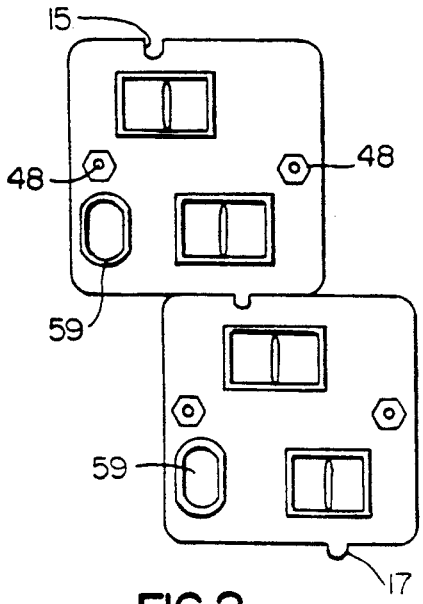
FIG. 2 is a front view of two modularly stacked connectors of FIG. 1.

Referring now to the drawing wherein like numerals indicate like elements throughout and more particularly FIG. 1 thereof, a connector is shown which includes a housing having a connector body 5, nose plate 7, and cover plate 9 all of which can be fabricated from molded plastic resin, such as a glass filled nonelectrically conductive resin. The connector body 5 has separate recesses 11 molded in the plastic for receiving terminal assemblies 13, the recesses are preferably situated diagonally relative to one another in the connector body. A central portion of each of the recesses extend completely through the connector body. The connector body 5 also has a key slot 15 on one edge and a key tab 17 on an opposite edge to permit modular stacking of multiple terminal assemblies diagonally offset from one another, as shown in FIG. 2.

Each terminal assembly comprises a terminal 21 and a flexible connector 23. The terminal includes a stab portion 25 which extends away from the connector body 5 for mating with a fixed receptacle 27 surrounded by a shroud 28, which can be mounted on a bus bar 29, shown in FIG. 3B using a nut and bolt or machine brazing. The terminal further includes a base guide 31 which extends away from the stab portion and support ears 33 which extend away perpendicularly in opposite directions from the stab portion 25. The stab portion 25, base guide 31, and support ears 33 form a terminal 21 having the shape of a cross and can be fabricated from an electrically conductive material such as copper or fabricated from brass and tin lead plated. The connectors are each slidably positioned in a separate recess 11 in the connector body each using two compression springs 35 which are separated by the base guide 31 and enclosed by the support ears 33 and the connector body 5. The base guide extends through the central portion of the recess that extends completely through the connector body. Any lateral motion of the stab from the equilibrium position compresses one spring between the base guide and the side of the recess while allowing the other spring to expand, achieving a centering action.

The base portion 31 of terminal 21 is electrically connected to a high flexibility electrical cable 23 which is located on the opposite side of the connector body from the stab portion of the terminal. Ultrasonic welding or mechanical fastening can be used for securing the base portion to one end of a high flexibility copper braided cable. The nose plate 7 is molded with shrouded openings 37 extending away from the connector body and with pins 39 used to align the nose plate with the connector body. Pins 39 fit into corresponding holes 41 in the connector body. The stab portions extend through corresponding holes in the nose plate and are surrounded circumferentially by shrouds 37, see FIG. 3A. Terminals used for making ground connections have terminal stab portions which are longer and therefore extend further from the connector housing to provide the necessary make first and break last connections. The cover plate is molded with a terminal electrical isolation barrier 43 to separate the two connector assemblies 13.

Figure 3A:
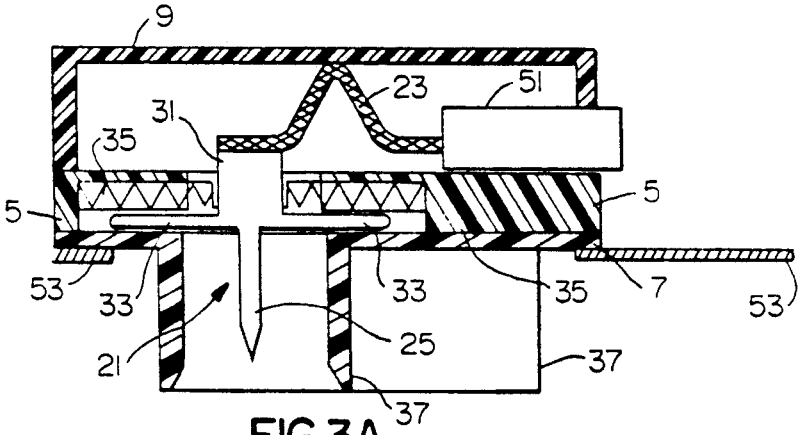
FIG. 3A is a top view partly in section of the connector of FIG. 1

The nose plate 7 and cover plate 9 are secured to opposite sides of the connector body using threaded fasteners 45 and nuts 48, one of which is shown in FIG. 1, which extend through holes 47, to hold the housing together thereby capturing the terminals and springs in place in a cavity formed by the connector body and the nose plate. The braided cable 23 can be provided with a preformed "V" shape as shown in FIG. 3A. The flexible cable allows the terminal to move laterally unimpeded. The other end of the cable can extend outside the housing and be connected to a commercially available connector 51 providing a quick connect/disconnect feature, such as an Anderson Power Products, Boston Massachusetts Modular Power Pole connector. The other end the cable 23 can alternatively be secured to an external portion of the cover plate using a locking screw with any additional connections made there.

The shrouds 37 are sized to not interfere with the side to side motion of the terminal when engaged with the mating half of the connector 27 which is surrounded by a shroud 28. The shroud 37 extends further out than the stab providing mechanical and electrical protection for the terminal. The connector is shown positioned in an aperture of a chassis 53.

Figure 4:
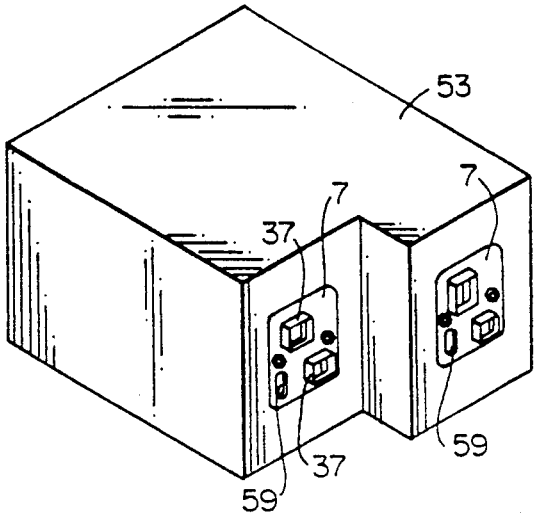
FIG. 4 is an axonometric view of a chassis having connectors in accordance with the present invention mounted on separate parallel planes.
Figure 3B:
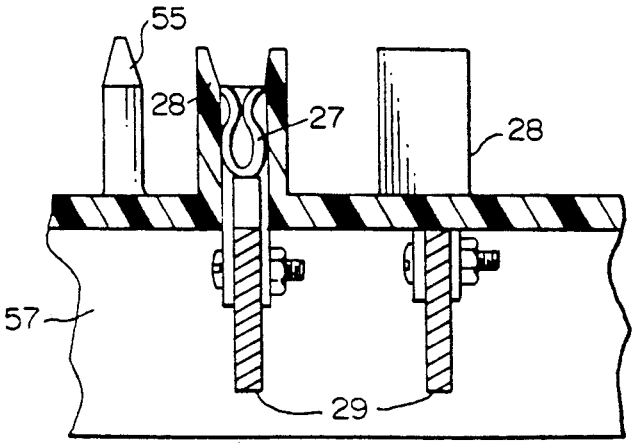
FIG. 3B is a top view partly in section of the mating receptacles and bus bars.

Referring now to FIGS. 3A and 3B, the two terminals within the connector assembly are staggered diagonally to allow plugging into fixed busing. Parallel buses 29, which carry three phase input power or DC output and return power, have connectors such as Amp Corporation, Harrisburg Pa., PDS 062F 100 Ampere connectors 27 which are machine brazed or bolted to parallel bus bars in a staggered arrangement corresponding to the terminals 21. Connectors 27 are selected to mate with terminals 21. The chassis can be slid on a shelf of a rack with the portion of the chassis having the connectors slid in first to engage the connectors 27 attached to the vertically running bus bars. Ganged terminals on different parallel planes of the chassis can be accommodated as shown in FIG. 4. A tapered guide pin 55 which can be mounted on the electrically insulated spacer bar 57 which assures proper spacing between adjacent bus bars, can be used to help align the terminals by means of guide pin alignment hole 59 in the nose plate 7 and connector body 5, with the connector on the bus bars. As the chassis 53 is slid towards the bus bars 29 the tapered guide pin 55 aligns with the elongated guide pin receiver 59 in the nose plate 7. The guide pin receiver has a chamfered edge and is sized to assure blind plugging if the guide pin enters the guide pin receptacle.

In one embodiment of a connector assembly providing 480 VAC at 60 A capability, compression springs providing 3 to 5 pounds of opposing force to each terminal are used. The terminals are self centering but can move 5 mm in opposite directions for alignment purposes providing a totals of 10 mm of float. The terminals are also sized to accept vertical misalignment of plus or minus 2 mm as well as plus or minus 2 mm insertion depth variation. The stabs are 16 mm high and 1.6 mm thick.

Figure 5:
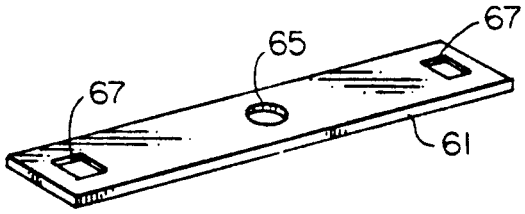
FIG. 5 is an axonometric view of a band shown before forming used to provide spring biasing to another embodiment of a connector in accordance with the present invention.
Figure 6:
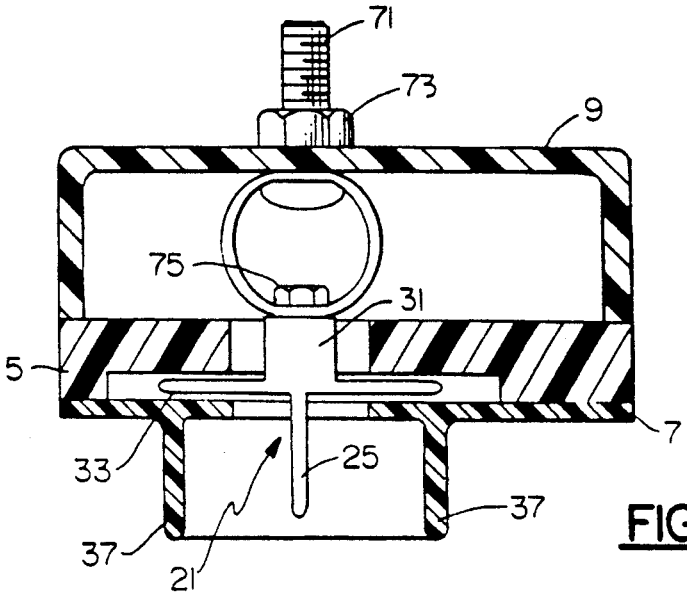
FIG. 6 shows a connector having a band with a circular cross section in accordance with the present invention.
Figure 7:
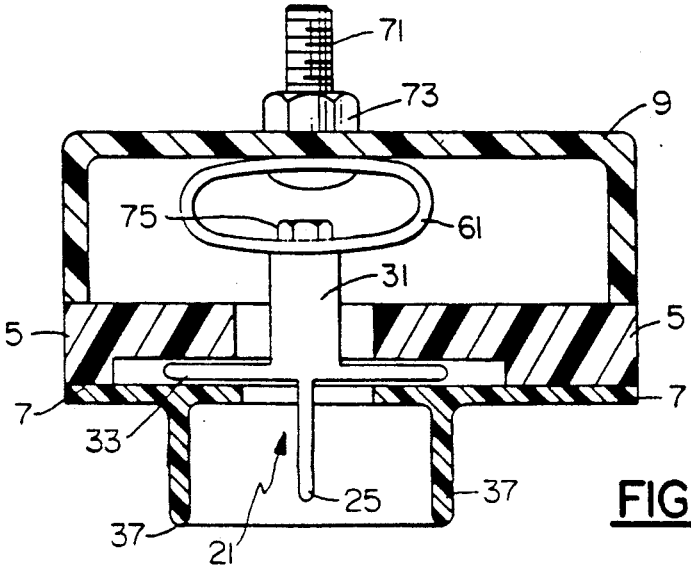
FIG. 7 shows a connector having a band with an oval cross section in accordance with the present invention.

Another embodiment of the present invention is shown in FIGS. 5–7. A terminal 21 is shown slidably mounted in a receptacle in a connector body 5. Terminal 21 has the same configuration as the terminal shown in FIG. 1. An electrically conductive spring band 61, shown before bending in FIG. 5, has an opening 65 in the center and a square opening 67 near either end, is bent with the two square holes overlapped to form a band having the shape of an open ended cylinder which can have a round or oval cross section as shown in FIG. 6 and 7, respectively. A conductive fastener such as a carriage bolt 71 with a square shank secures the ends of the loop to the cover by way of a square opening through the cover plate 9 and a nut 73. The carriage bolt 71 can be fabricated from hard brass, for example. A threaded fastener 75 secures the band through hole 65 to the base 31 of the terminal 21. The axis of the cylinder is thus kept perpendicular to the desired side to side motion of the terminal 21 in the cavity. The band 61 provides self centering of the terminal while allowing the stab 25 to move from side to side when a force is exerted on the stab causing the band to deform. The spring band can be fabricated from an electrically conductive material such as a copper base spring alloy. A band 16 mm wide by 0.8 mm thick can carry 100 amperes. The band provides spring biasing and centering of the stab in the housing as well as electrically connecting terminal 21 to threaded terminal 71. Multiple terminals can be used in single housing having key tabs and key slots as shown in FIG. 1.

The foregoing has described a high voltage, high current multiple terminal pluggable connector which is capable of blind plugging and self alignment.

While the invention has been particularly shown and described with reference to preferred embodiments thereof, it will be understood by those skilled in the art that various changes may be made therein without departing from the spirit and scope of the invention.

We claim:

1. A connector comprising:

a housing including a connector body defining a recess portion having a central aperture extending therethrough, a nose plate having a shroud, said nose plate defining an opening surrounded by said shroud, said shroud extending away from said housing, and a cover plate, said cover plate and nose plate secured to opposite sides of said connector body, with said aperture in said connector body and said nose plate opening aligned with one another, said nose plate covering a portion of said recess and thus creating a cavity in said housing;

a terminal having a base and a stab portion extending from said base, said base slidably mounted in said cavity, with said stab portion extending through said opening; and spring means for biasing said stab portion to a central position in said opening.

2. The connector of claim 1 further comprising a plurality of terminals and said cover plate having at least one terminal isolation barrier to separate said terminals from one another in the interior of the housing.

3. The connector of claim 1 wherein said spring means comprises a band of spring material mounted at one point along the band to said base of said terminal and at an opposite point along said band to said housing, said band biasing said stab portion to a central position in said opening.

4. The connector of claim 3 wherein said band comprises an electrically conductive material for providing an electrical connection to said terminal.

5. The connector of claim 4 wherein the cross section of said band is generally circular.

6. The connector of claim 4 wherein the cross section of said band is generally flat.

7. A multi-terminal connector for coupling to connectors mounted on bus bars comprising:

a housing defining a plurality of cavities therein, each having a central portion with an opening to the exterior of said housing, said housing further including key tabs and key slots;

a plurality of terminals each having a base and a stab portion extending from said base, each of said bases slidably mounted in a corresponding one of said cavities with said stab portions extending through said openings, said stab portions being staggered diagonally relative to one another, said key tabs and key slots of said housing permitting stacking of housings thereby staggering terminals of the stacked housings; and spring means for biasing each of said stab portions to a central position in its respective said opening away from the perimeter of the opening.

8. The connector of claim 7 wherein said spring means comprises a pair of springs situated on either side of said terminal, biasing said stab portion to a central position in said opening.

9. The connector of claim 7 wherein at least one of said terminals further comprises ear portions extending perpendicularly in opposite directions from said stab portion with said terminal having the general shape of a cross.

10. The connector of claim 7 wherein said housing further includes a plurality of shrouds, spaced away from and circumferentially surrounding a respective one of said stab portions, said shrouds extending away from said housing.

11. The connector of claim 7 wherein said housing comprises a connector body defining a plurality of recesses each having a central aperture extending therethrough, a nose plate having a plurality of shrouds extending away from said housing, said nose plate defining a plurality of openings each surrounded by respective one of said shrouds, and a cover plate having at least one terminal isolation barrier to separate said terminals from one another in the interior of the housing, said cover plate and said nose plate secured to opposite sides of said connector body, with said apertures in said connector body and said nose plate openings aligned with one another, said nose plate covering a portion of each of said recesses creating a plurality of cavities, said housing being adapted to being affixed to a structure.

12. The connector of claim 7 wherein said spring means comprises a band of spring material mounted at one point along the band to said base of said terminal and at an opposite point along said band to said housing, said band biasing said stab portion to a central position in said opening.

13. The connector of claim 12 wherein said band comprises an electrically conductive material for providing an electrical connection to said terminal.

14. The connector of claim 13 wherein the cross section of said band is generally circular.

15. The connector of claim 13 wherein the cross section of said band is generally oval.

* * * * *